US008641554B1

(12) United States Patent
Hocknell et al.

(10) Patent No.: US 8,641,554 B1
(45) Date of Patent: Feb. 4, 2014

(54) GOLF CLUB WITH FACE ANGLE ADJUSTABILITY

(75) Inventors: Alan Hocknell, Carlsbad, CA (US); Matthew T. Cackett, San Diego, CA (US); D. Clayton Evans, San Marcos, CA (US)

(73) Assignee: Callaway Golf Company, Carlsbad, CA (US)

( * ) Notice: Subject to any disclaimer, the term of this patent is extended or adjusted under 35 U.S.C. 154(b) by 283 days.

(21) Appl. No.: 13/229,436

(22) Filed: Sep. 9, 2011

Related U.S. Application Data

(60) Continuation-in-part of application No. 13/186,118, filed on Jul. 19, 2011, now Pat. No. 8,096,895, which is a continuation of application No. 13/013,656, filed on Jan. 25, 2011, now Pat. No. 8,002,644, which is a division of application No. 12/692,428, filed on Jan. 22, 2010, now abandoned, which is a division of application No. 11/928,146, filed on Oct. 30, 2007, now abandoned, which is a continuation of application No. 11/461,132, filed on Jul. 31, 2006, now abandoned, which is a continuation-in-part of application No. 10/904,581, filed on Nov. 17, 2004, now Pat. No. 7,083,529.

(51) Int. Cl.
*A63B 51/02* (2006.01)

(52) U.S. Cl.
USPC ..... 473/307; 473/308; 473/245

(58) Field of Classification Search
USPC ..... 473/307, 309, 288, 244–248
See application file for complete search history.

(56) References Cited

U.S. PATENT DOCUMENTS

| | | | | | |
|---|---|---|---|---|---|
| 5,176,681 | A * | 1/1993 | Lawes et al. | ..... | 606/64 |
| 5,951,411 | A * | 9/1999 | Wood et al. | ..... | 473/307 |
| 6,089,991 | A * | 7/2000 | Yeh | ..... | 473/305 |
| 6,602,149 | B1 * | 8/2003 | Jacobson | ..... | 473/329 |
| 6,620,054 | B2 * | 9/2003 | Tseng | ..... | 473/306 |
| 7,887,431 | B2 * | 2/2011 | Beach et al. | ..... | 473/307 |
| 8,029,383 | B2 * | 10/2011 | Yamamoto | ..... | 473/307 |
| 8,246,484 | B2 * | 8/2012 | Sato et al. | ..... | 473/307 |
| 8,277,333 | B2 * | 10/2012 | Thomas et al. | ..... | 473/307 |
| 8,303,431 | B2 * | 11/2012 | Beach et al. | ..... | 473/307 |
| 2004/0018887 | A1 * | 1/2004 | Burrows | ..... | 473/307 |
| 2010/0197423 | A1 * | 8/2010 | Thomas et al. | ..... | 473/307 |
| 2011/0034266 | A1 * | 2/2011 | Evans et al. | ..... | 473/307 |
| 2011/0111881 | A1 * | 5/2011 | Sander et al. | ..... | 473/307 |
| 2011/0123265 | A1 * | 5/2011 | Moore | ..... | 403/361 |
| 2013/0053161 | A1 * | 2/2013 | Moore | ..... | 473/244 |

* cited by examiner

*Primary Examiner* — Stephen L. Blau
(74) *Attorney, Agent, or Firm* — Michael A. Catania; Rebecca Hanovice; Sonia Lari

(57) ABSTRACT

A golf club having removable components is disclosed herein. The golf club having removable components includes a club head, a shaft, and a connection assembly. The connection assembly includes a sleeve mounted on the tip end of the shaft and a screw-cap. The sleeve has an offset aperture for receiving the tip end of the shaft in order to adjust the face angle of the golf club. The screw-cap is mounted over the sleeve and includes a body having an upper area and a threaded area, the latter of which is capable of engaging the upper threaded portion of the hosel to removably secure the shaft to the club head.

7 Claims, 6 Drawing Sheets

GOLF CLUB WITH FACE ANGLE ADJUSTABILITY

CROSS REFERENCES TO RELATED APPLICATIONS

The present application is a continuation-in-part application of U.S. patent application Ser. No. 13/186,118, filed on Jul. 19, 2011, which is a continuation application of U.S. patent application Ser. No. 13/013,656, filed on Jan. 25, 2011, now U.S. Pat. No. 8,002,644, which is a divisional application of U.S. patent application Ser. No. 12/692,428, filed on Jan. 22, 2010, now abandoned, which is a divisional application of U.S. patent application Ser. No. 11/928,146, filed on Oct. 30, 2007, now abandoned, which is a continuation of U.S. patent application Ser. No. 11/461,132, filed on Jul. 31, 2006, now abandoned, which is a continuation-in-part of U.S. patent application Ser. No. 10/904,581, filed on Nov. 17, 2004, now U.S. Pat. No. 7,083,529, all of which are hereby incorporated by reference in their entireties.

STATEMENT REGARDING FEDERALLY SPONSORED RESEARCH OR DEVELOPMENT

Not Applicable

BACKGROUND OF THE INVENTION

1. Field of the Invention

The present invention relates to a golf club having an improved connection for interchanging a shaft with a golf club head, components for the golf club, and a method of manufacturing the components.

2. Description of the Related Art

In order to improve their game, golfers often customize their equipment to fit their particular swing. Golf equipment manufacturers have responded by increasing the variety of clubs available to golfers. For example, a particular model of a driver-type golf club may be offered in several different loft angles and lie angles to suit a particular golfer's needs. In addition, golfers can choose shafts, whether metal or graphite, and adjust the length of the shaft to suit their swing. Golf clubs that allow shaft and club head components to be easily interchanged facilitate this customization process.

One example is Wheeler, U.S. Pat. No. 3,524,646 for a Golf Club Assembly. The Wheeler patent discloses a putter having a grip and a putter head, both of which are detachable from a shaft. Fastening members, provided on the upper and lower ends of the shaft, have internal threads, which engage the external threads provided on both the lower end of the grip and the upper end of the putter head shank to secure these components to the shaft. The lower portion of the shaft further includes a flange, which contacts the upper end of the putter head shank, when the putter head is coupled to the shaft.

Another example is Walker, U.S. Pat. No. 5,433,442 for Golf Clubs with Quick Release Heads. The Walker patent discloses a golf club in which the club head is secured to the shaft by a coupling rod and a quick release pin. The upper end of the coupling rod has external threads that and engage the internal threads formed in the lower portion of the shaft. The lower end of the coupling rod, which is inserted into the hosel of the club head, has diametric apertures that align with diametric apertures in the hosel to receive the quick release pin.

Still another example is Roark, U.S. Pat. No. 6,547,673 for an Interchangeable Golf Club Head and Adjustable Handle System. The Roark patent discloses a golf club with a quick release for detaching a club head from a shaft. The quick release is a two-piece connector including a lower connector, which is secured in the hosel of the club head, and an upper connector, which is secured in the lower portion of the shaft. The upper connector has a pin and a ball catch that protrude radially outward from the lower end of the upper connector. The upper end of the lower connector has a slot formed therein for receiving the upper connector pin, and a separate hole for receiving the ball catch. When the shaft is coupled to the club head, the lower connector hole retains the ball catch to secure the shaft to the club head.

Two further examples are published applications to Burrows, U.S. Publication Numbers 2004/0018886 and 2004/0018887, both of which are for a Temporary Golf Club Shaft-Component Connection. The Burrows applications disclose a temporary connection that includes an adapter insert, a socket member, and a mechanical fastener. The adapter insert, which is mounted on a shaft, includes a thrust flange. The socket member, which is mounted on the other golf club component (e.g., a club head), includes a thrust seat for seated reception of the thrust flange. The mechanical fastener (e.g., a compression nut or a lock bolt) removably interconnects the adapter insert and the socket member.

The prior art temporary head-shaft connections have several disadvantages. First, they require that the golf club head have a conventional hosel for attachment. Second, these connections add excessive weight to the club head, thereby minimizing the amount of discretionary mass that may be distributed in the club head to optimize mass properties. Third, the prior art connections offer small, faying surfaces for centering and reacting to bending moments.

Currently the time required to machine the existing geometry of an interior hosel is between 10-20 minutes depending on the set-up time of the machinist. The time and resources to set up the golf club head component for machining adds to the overall costs.

In the current method employed to machine the interior hosel hole geometry a ball end-mill cutter is used. The ball end-mill cutter spirals down the hosel hole in a constant X, Y, and Z axis positioning method which cuts the hosel hole geometry to the finished dimensions. This descending-spiraling method is slow and consequently costly due to the time required for the process.

BRIEF SUMMARY OF THE INVENTION

One aspect of the present invention is a golf club having removable components. The golf club comprises a club head, shaft and a connection assembly. The club head has a body with a hosel. The hosel has an upper threaded portion and a lower portion. The upper threaded portion has a threaded cross-section. The lower portion has a ribbed cross-section. The shaft has a tip end and a butt end. The connection assembly comprises a sleeve and a screw-cap. The sleeve mounted on the tip end of the shaft. The sleeve has a body with a top section and a lower section. The lower section has a tapered, multi-faceted surface for engaging the lower portion of the hosel. The sleeve also comprises an aperture for receiving the tip end of the shaft, wherein the aperture is at an angle ranging from 1 to 3 degrees relative to a centerline of the body. The screw-cap has a body with a central aperture. The screw cap is mounted over the sleeve. The body of the screw-cap has an upper area and a threaded area. The threaded area engages the upper threaded portion of the hosel of the club head for removably securing the shaft to the club head. The face angle and the loft angle of the golf club are adjusted by adjusting the orientation of the shaft in the club head.

Another aspect of the present invention is a golf club having removable components with the golf club comprising a multi-material club head, a shaft and a connection assembly. The club head comprises a face cup and an aft-body. The face cup composed of a metal material and including a striking face, a return portion and a hosel. The hosel has an upper threaded portion, a central portion and a lower portion. The upper threaded portion having a plurality of threads thereon. The central portion has a circular cross-section. The lower portion has a tapered, ribbed cross-section. The shaft having a tip end and a butt end. The connection assembly comprises a sleeve and a screw-cap. The sleeve mounted on the tip end of the shaft. The sleeve has a body with a top section and a lower section. The lower section has a tapered, multi-faceted surface for engaging the lower portion of the hosel. The sleeve also comprises an aperture for receiving the tip end of the shaft, wherein the aperture is at an angle ranging from 1 to 3 degrees relative to a centerline of the body. The screw-cap has a body with a central aperture. The screw cap is mounted over the sleeve. The body of the screw-cap has an upper area and a threaded area. The threaded area engages the upper threaded portion of the hosel of the club head for removably securing the shaft to the club head. The face angle and the loft angle of the golf club are adjusted by adjusting the orientation of the shaft in the club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
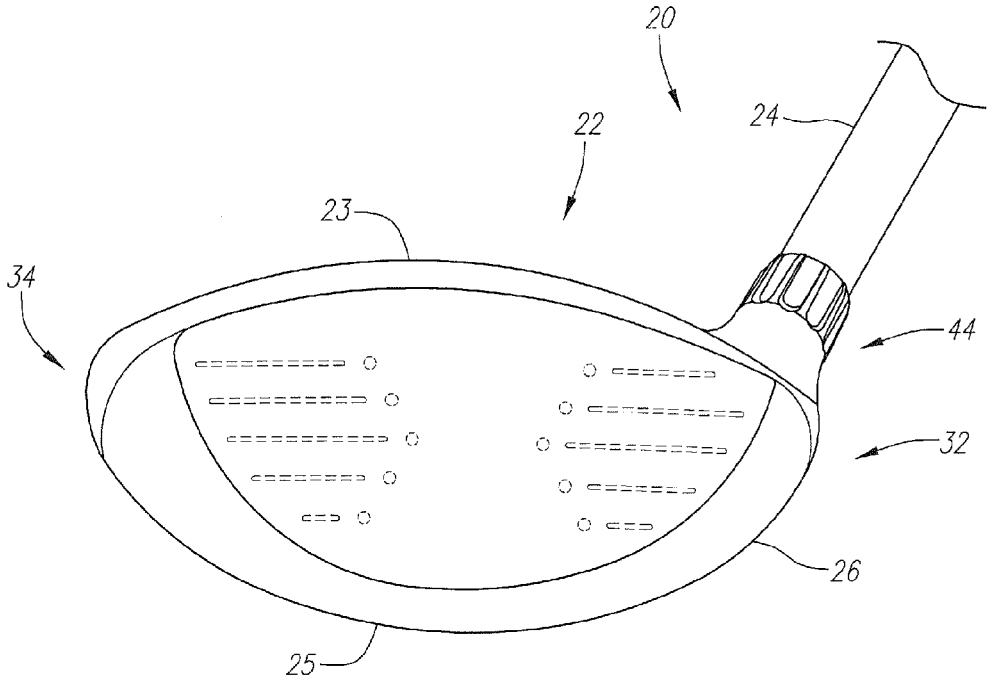
FIG. 1 is a front plan view of a golf club.
Figure 2:
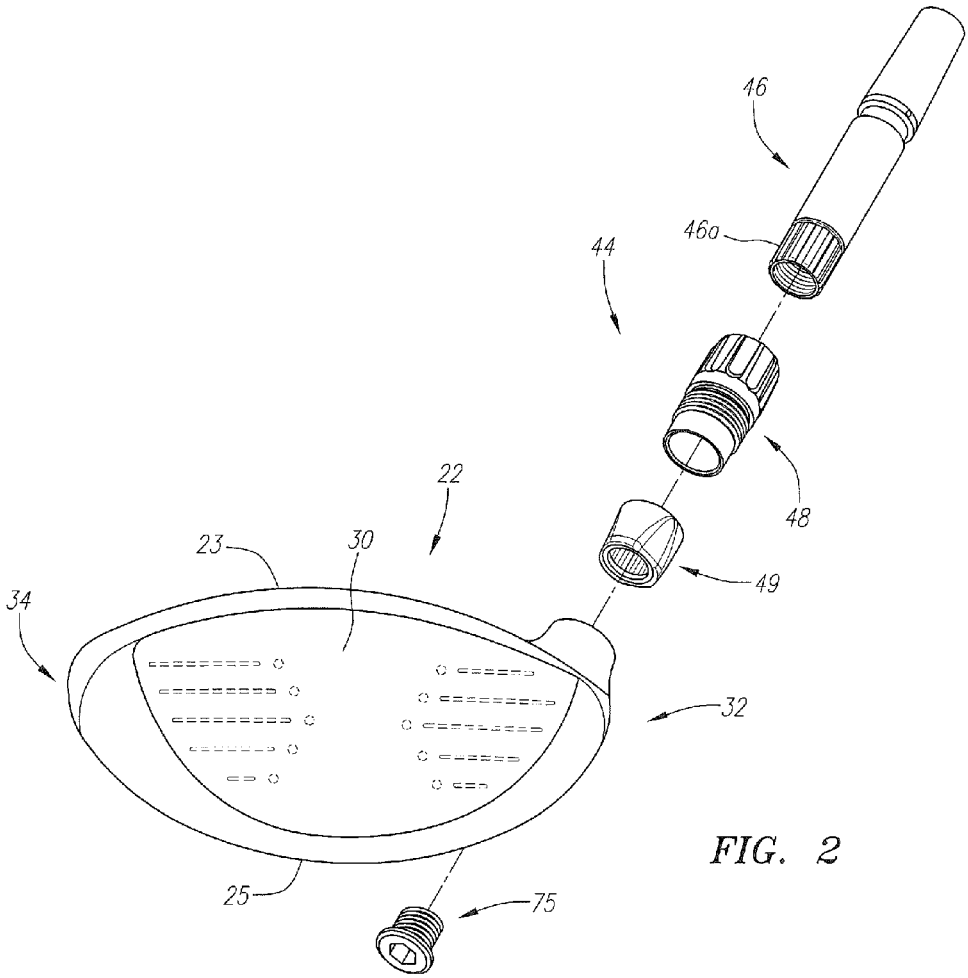
FIG. 2 is an exploded top perspective view of the golf club of FIG. 1 illustrating the various components, including a club head, a shaft, and the connection assembly, which includes a sleeve and a screw-cap.

As shown in FIGS. 1-2, a golf club is generally designated 20. Golf club 20 has a club head 22 and a shaft 24 that is coupled to club head 22. Club head 22 is preferably a wood-type golf club head, such as a driver, a fairway wood, or even a hybrid iron-wood-type club, but may also be an iron-type club head. Club head 22 includes a body 26 having a striking face 30, a crown portion 23, a sole portion 25, a heel end 32 and a toe end 34. Striking face 30 generally extends along the front of club head 22 from heel end 32 to toe end 34.

The club head 22 is alternatively a club head such as disclosed in U.S. Pat. No. 6,758,763 for a Multiple Material Golf Club Head, which is hereby incorporated by reference in its entirety. The club head 22 is alternatively a club head such as disclosed in U.S. Pat. No. 7,166,038 for a Golf Club Head, which is hereby incorporated by reference in its entirety. The club head 22 is alternatively a club head such as disclosed in U.S. Pat. No. 7,273,419 for a Multiple Material Golf Club Head, which is hereby incorporated by reference in its entirety. The club head 22 is alternatively a club head such as disclosed in U.S. Pat. No. 7,410,428 for a Golf Club Head With A High Moment Of Inertia, which is hereby incorporated by reference in its entirety.

Body 26 is preferably composed of a metallic material, such as titanium, titanium alloy, stainless steel, or the like. Alternatively, body 26 may be composed of multiple materials, such as a metal face cup attached to an aft-body composed of a different material, such as a carbon composite material, or a stainless steel body with a carbon composite crown. Body 26 preferably has a hollow interior and includes a hosel for receiving shaft. Where body 26 is comprised of a cup face and an aft-body, the hosel is provided in cup face. The hosel is preferably an internal hosel that extends into body 26 with an opening in crown portion. Alternatively, club head 22 may be provided with an external hosel (not shown) rather than an internal one.

The shaft 24 is preferably composed of a graphite material, however, the shaft 24 is alternatively composed of a metallic material, such as stainless steel or titanium. Alternatively, the shaft 24 is composed of a hybrid of graphite and metal. The shaft 24 is coupled to club head 22 using a connection assembly 44 that provides for easy assembly, disassembly and reassembly, thereby facilitating customization of golf club 20.

The connection assembly 44 preferably comprises a sleeve 46 and a screw-cap 48. Connection assembly 44 cooperates with a hosel of club head 22 to secure shaft 24 to club head 22. Sleeve 46 is mounted on a tip end 50 of shaft 24. Shaft 24 with sleeve 46 mounted thereon is then inserted in the hosel of club head 22. Screw-cap 48 secures sleeve 46 to hosel to retain shaft 24 in connection with club head 22.

The sleeve 46, has an aperture formed in an upper end thereof for receiving tip end of shaft 24. The sleeve 46 is fixedly secured to shaft 24 using an adhesive, such as epoxy. The sleeve 46 is preferably comprised of a metal material, such as titanium alloys and aluminum alloys.

Figure 3:
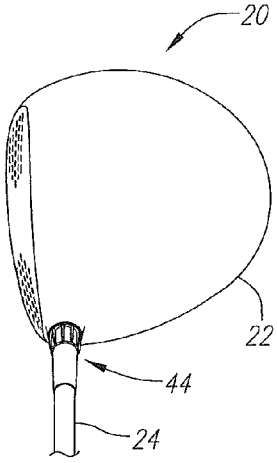
FIG. 3 is a top view of a golf club with a closed face angle.

FIG. 3 is a top view of a golf club 20 with a closed face angle.

Figure 3A:
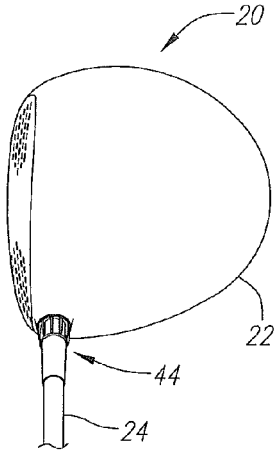
FIG. 3A is a top view of a golf club in a neutral position with a closed face angle.

FIG. 3A is a top view of a golf club 20 in a neutral position with a closed face angle.

Figure 3B:
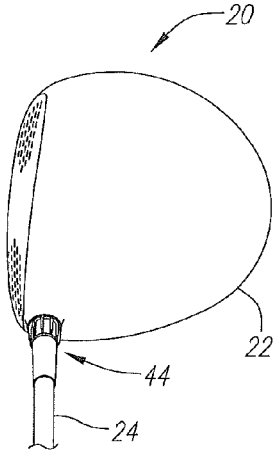
FIG. 3B is a top view of a golf club with an open face angle.

FIG. 3B is a top view of a golf club 20 with an open face angle.

Figure 4:
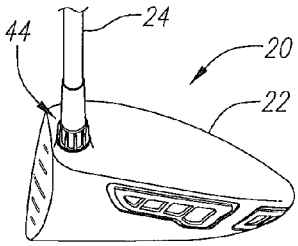
FIG. 4 is a side view of a golf club with a club head rotated around a shaft axis to obtain a square face angle with a loft angle measured at approximately 17 degrees.

FIG. 4 is a side view of a golf club 20 with a club head rotated around a shaft axis to obtain a square face angle with a loft angle measured at approximately 17 degrees.

Figure 4A:
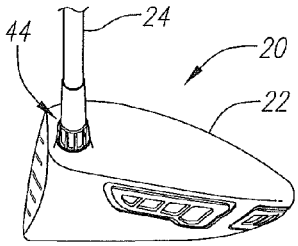
FIG. 4A is a side view of a golf club with a club head rotated around a shaft axis to obtain a square face angle with a loft angle measured at approximately 14 degrees.

FIG. 4A is a side view of a golf club 20 with a club head 22 rotated around a shaft axis to obtain a square face angle with a loft angle measured at approximately 14 degrees.

Figure 4B:
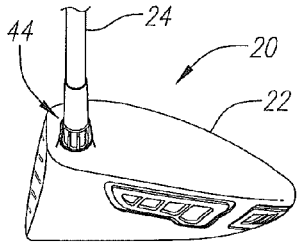
FIG. 4B is a side view of a golf club with a club head rotated around a shaft axis to obtain a square face angle with a loft angle measured at approximately 12 degrees.

FIG. 4B is a side view of a golf club 20 with a club head 22 rotated around a shaft axis to obtain a square face angle with a loft angle measured at approximately 12 degrees.

Figure 7:
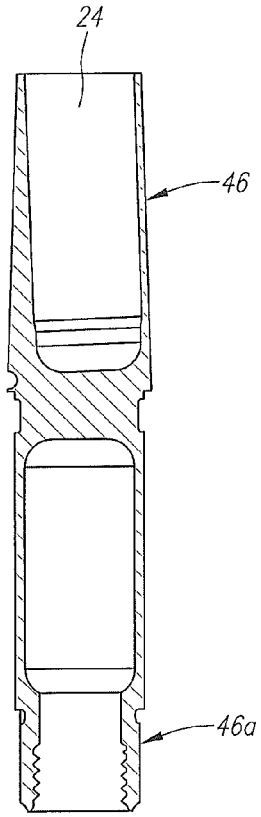
FIG. 7 is an isolated cross-sectional view of a sleeve of a connection assembly for a golf club.

As shown in FIG. 7, the sleeve 46, which preferably has an overall length $L_S$ of at least 1.500 inches, includes a body having a top section and a lower splined section 46*a*. The top section has an aperture formed therein. The aperture preferably has a diameter $D_A$ that complements the outer diameter of tip end of shaft 24. A depth $L_A$ of aperture is preferably sufficient to receive at least 1.000 inch of tip end of shaft 24. In one embodiment of the invention, the depth $L_A$ is approximately 1.126 inches.

The lower splined section 46*a* of sleeve 46 has a length $L_L$ preferably in the range of 0.375 inch to 0.525 inch to provided sufficient contact surface area. When the screw-cap is tightened down on the sleeve, the screw-cap forces the multi-faceted lower section of the sleeve against the mating contact surfaces of the lower portion of the hosel of the golf club head, and all rotation is mechanically prohibited.

Figure 8:
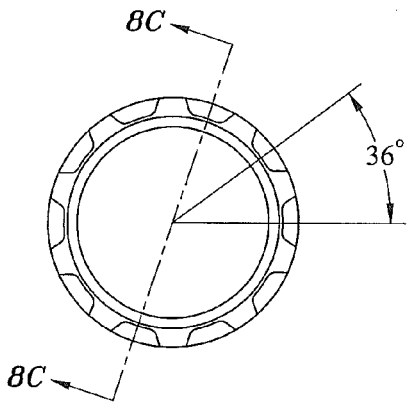
FIG. 8 is a top view of a screw cap of a connection assembly for a golf club.
Figure 8A:
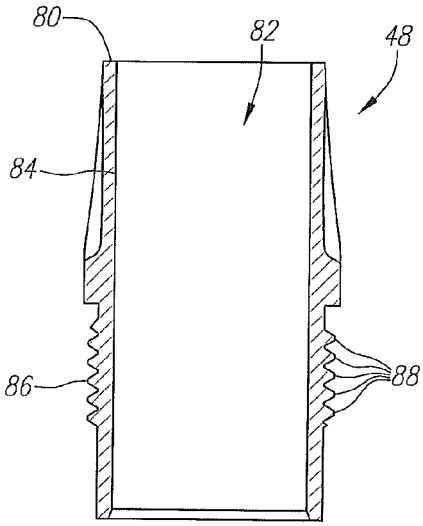
FIG. 8A is a cross-sectional view along line A-A of the screw cap of FIG. 8.
Figure 8B:
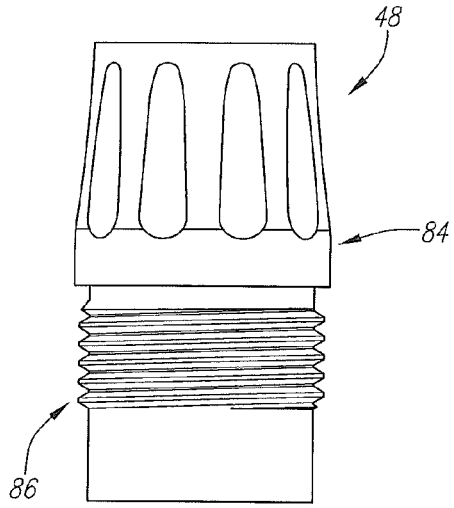
FIG. 8B is a front view of the screw cap of FIG. 8.

Screw-cap 48, illustrated in FIGS. 8-8B, is preferably comprised of a lightweight metal material, such as a titanium alloy or an aluminum alloy. Screw-cap 48 includes a body 80 having a central aperture 82. Screw-cap 48 is mounted onto shaft 24 over sleeve 46. Screw cap 48 includes an upper area 84 and a threaded area 86. Threaded area 86 is provided with a plurality of threads 88, which engage threads 64 of upper threaded portion 60 of hosel to secure shaft 24 to club head 22.

Figure 5:
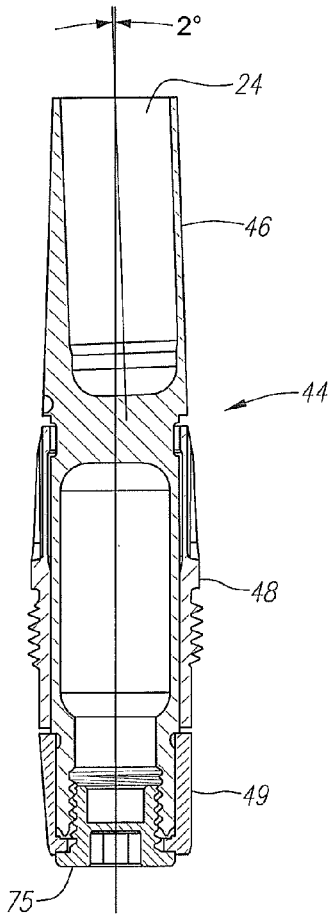
FIG. 5 is a cross-sectional view of a connection assembly for a golf club.
Figure 6:
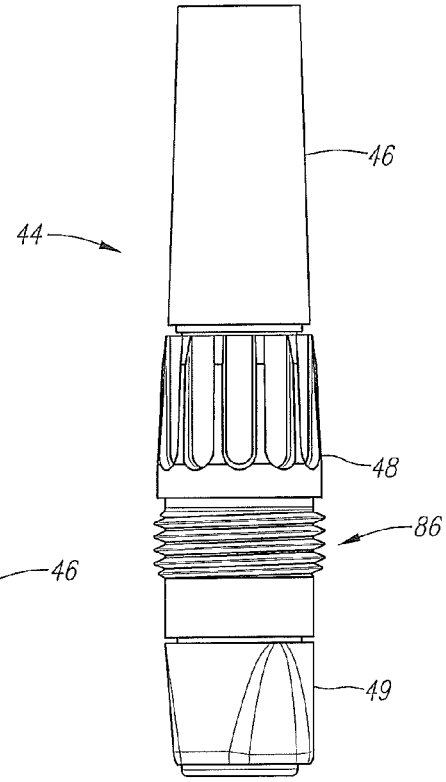
FIG. 6 is an isolated front view of a connection assembly for a golf club.

As illustrated in FIGS. 5 and 6, the connection assembly 44 includes the sieve 46, the screw cap 48 a fastener screw 75, and a splined tri-lobe 49, which mates with the splined lower section 46*a* of the sleeve 46,*e* and which preferably prevents movement of the connection assembly 44 and shaft 24 within the hosel of the golf club head 22. As shown in FIGS. 5 and 7, the aperture of the sleeve 46 is offset by at least two degrees relative to a centerline of the sleeve body allows for fitting enhancements by increasing (closing) or decreasing (opening) a golf club's face angle with small corresponding changes in loft by simple inserting the shaft into one of its three possible positions in the golf club head 22.

Golf club 20 is preferably assembled by placing the screw-cap 48 and the sleeve 46 over the tip end of shaft 24. The sleeve 46 is preferably secured to shaft 24 by an adhesive, such as epoxy. The tip end of the shaft 24, with sleeve 46 affixed therein, is then inserted into hosel of club head 22. The tapered multi-faceted surface of lower tri-lobe 49 engages with a lower portion of the hosel. Next, the screw-cap 48 is slid along the tip end of the shaft 24, such that its threads 88 engage threads of upper threaded portion of the hosel. A special tool (not shown) may be provided to ensure that screw-cap 48 is properly tightened with the correct amount of torque. When the screw-cap 48 is fully tightened to upper threaded portion of hosel of the club head 22, the lower end of the screw-cap 48 seats on a ledge of the sleeve 46 to prevent the sleeve 46, and therefore shaft 24, from separating from club head 22.

Figure 9:
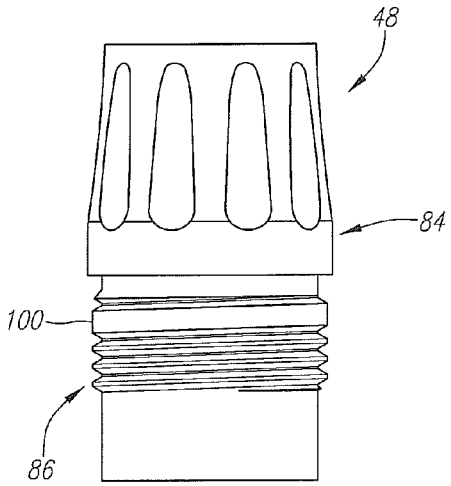
FIG. 9 is a front view of an embodiment of a screw cap with NYLOK on the threads.
Figure 10:
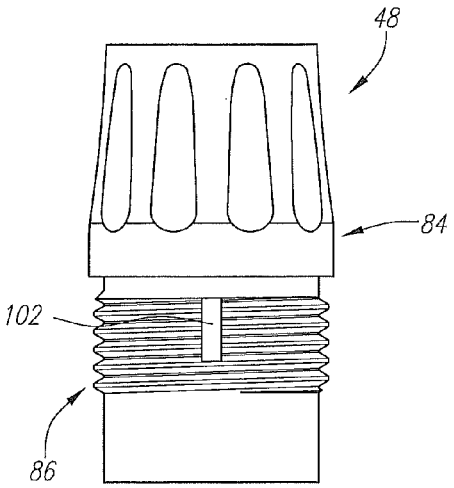
FIG. 10 is a front view of an embodiment of a screw cap with NYLOK on the threads.
Figure 11:
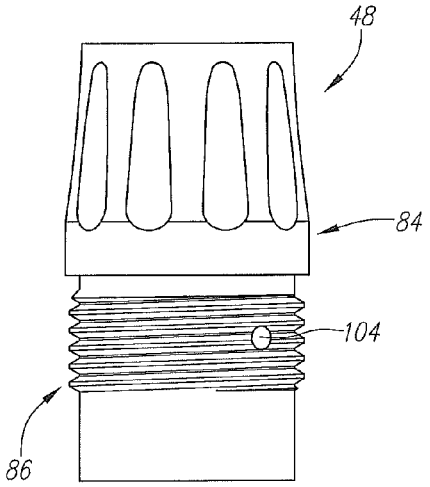
FIG. 11 is a front view of an embodiment of a screw cap with NYLOK on the threads.

In addition, a compressible polymeric material may be provided on some or all of the threads 88 of screw-cap 48. Alternatively, the polymeric material may be applied to threads of hosel. When mating threads and 88 of hosel and the screw-cap 48, respectively, are engaged, the polymeric material is compressed and a counterforce is created. This counterforce creates a stronger contact between the threads of the two components and creates a positive resistance to vibration and loosening. One such material is NYLOK available from Nylok Corporation. FIGS. 9-11 show various configurations of NYLOK material on screw-cap 48. In FIG. 9, a patch 100 of NYLOK material may be coated over one or more threads 88 of screw-cap 48. Patch 100 may have a height in the range of 0.01 inch to 0.5 inch, more preferably in the range of 0.04 inch to 0.3 inch, and even more preferably in the range of 0.1 inch to 0.2 inch. Patch 100 preferably covers between one-half and ten threads 88, and more preferably between one and five threads 88. Patch 100 may extend completely about one or more threads 88 of screw-cap 48 or only a portion thereof. For example, patch 100 may extend anywhere between 30° and 360° about screw-cap 48. The thickness of patch 100 is preferably between 0.005 inch to 0.050 inch.

In FIG. 10 a strip 102 of NYLOK material is coated across multiple threads 88 of screw-cap 48. Strip 102 may have a height in the range of 0.01 inch to 0.5 inch, more preferably in the range of 0.04 inch to 0.3 inch, and even more preferably in the range of 0.1 inch to 0.2 inch. The width of strip 102 may be between 0.01 inch and 0.2 inch, more preferably between 0.02 inch and 0.1 inch. Strip 102 preferably has a thickness of 0.03 to 0.15 inch.

FIG. 11 illustrates a pellet 104 of NYLOK material embedded in threads 88 of screw-cap 48. Pellet 104 may have a diameter of between 0.01 inch and 0.6 inch, more preferably between 0.03 and 0.15 inch. The thickness of pellet 104 is preferably between 0.03 inch and 0.15 inch.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf club having removable components, the golf club comprising:

a club head having a body with a hosel, the hosel having an upper threaded portion and a lower portion, the upper threaded portion having a threaded cross-section;

a shaft having a tip end and a butt end; and a connection assembly comprising a sleeve mounted on the tip end of the shaft, the sleeve having a body including a top section and a lower section, the sleeve also comprising an aperture for receiving the tip end of the shaft, wherein the aperture is at an angle ranging from 1 to 3 degrees relative to a centerline of the body, a splined tri-lobe, the splined tri-lobe mating with the lower section of the sleeve, the splined tri-lobe preventing movement of the connection assembly and shaft, wherein the splined tri-lobe is fastened to the sleeve with a separate fastener prior to the sleeve being inserted into the hosel, wherein the fastener is attached at a tip end of the sleeve opposite an end of the sleeve with the aperture for receiving the shaft, a screw-cap having a body with a central aperture, the screw cap mounted over the sleeve, the body of the screw-cap having an upper area and a threaded area, the threaded area capable of engaging the upper threaded portion of the hosel of the club head for removably securing the shaft to the club head;

whereby the face angle and the loft angle of the golf club are adjustable by adjusting the orientation of the shaft in the club head.

2. The golf club according to claim 1 further comprising a polymeric material provided on at least a portion of the threaded area of the screw-cap.

3. The golf club according to claim 2 wherein the polymeric material is a Nylok material.

4. The golf club according to claim 1 further comprising a polymeric material provided on at least a portion of the upper threaded portion of the hosel.

5. A golf club having removable components, the golf club comprising:

a club head including a face cup and an aft-body, the face cup comprised of a metal material and including a striking face and a hosel, the hosel having an upper threaded portion, a central portion and a lower portion, the upper threaded portion having a plurality of threads thereon, the central portion having a circular cross-section;

a shaft having a tip end and a butt end; and a connection assembly comprising a sleeve mounted on the tip end of the shaft, the sleeve having a body with a top section and a lower section, the sleeve also comprising an aperture for receiving the tip end of the shaft, wherein the aperture is at an angle ranging from 1 to 3 degrees relative to a centerline of the body, a splined tri-lobe, the splined tri-lobe mating with the lower section of the sleeve, the splined tri-lobe preventing movement of the connection assembly and shaft, wherein the splined tri-lobe is fastened to the sleeve with a separate fastener prior to the sleeve being inserted into the hosel, wherein the fastener is attached at a tip end of the sleeve opposite an end of the sleeve with the aperture for receiving the shaft, a screw-cap having a body with a central aperture, the screw cap mounted over the sleeve, the body of the screw-cap having an upper area and a threaded area, the threaded area capable of engaging the upper threaded portion of the hosel of the club head for removably securing the shaft to the club head;

whereby the face angle and the loft angle of the golf club are adjustable by adjusting the orientation of the shaft in the club head.

6. The golf club according to claim 5 further comprising a polymeric material provided on at least a portion of one of the threaded area of the screw-cap and the upper threaded portion of the hosel.

7. The golf club according to claim 6 wherein the polymeric material is a Nylok material.

* * * * *